US010029465B2

(12) United States Patent
Tsukamoto

(10) Patent No.: US 10,029,465 B2
(45) Date of Patent: Jul. 24, 2018

(54) LIQUID DISCHARGE HEAD, LIQUID DISCHARGE DEVICE, AND LIQUID DISCHARGE APPARATUS

(71) Applicant: Ryuji Tsukamoto, Kanagawa (JP)

(72) Inventor: Ryuji Tsukamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/444,927

(22) Filed: Feb. 28, 2017

(65) Prior Publication Data

US 2017/0253034 A1 Sep. 7, 2017

(30) Foreign Application Priority Data

Mar. 1, 2016 (JP) ..... 2016-039433
Dec. 27, 2016 (JP) ..... 2016-252475

(51) Int. Cl.
*B41J 2/145* (2006.01)
*B41J 2/14* (2006.01)

(52) U.S. Cl.
CPC ..... *B41J 2/145* (2013.01); *B41J 2/14032* (2013.01); *B41J 2/14145* (2013.01); *B41J 2/14201* (2013.01); *B41J 2002/14306* (2013.01); *B41J 2002/14483* (2013.01)

(58) Field of Classification Search
CPC ..... B41J 2/14032; B41J 2/14145; B41J 2/14201; B41J 2/145; B41J 2002/14306; B41J 2002/14483
USPC ..... 347/40
See application file for complete search history.

(56) References Cited

U.S. PATENT DOCUMENTS 5,087,930 A * 2/1992 Roy ..... B41J 2/155 347/22
2009/0284572 A1 11/2009 Katoh
2011/0169897 A1* 7/2011 Yokoyama ..... B41J 2/055 347/70
2015/0085021 A1* 3/2015 Govyadinov ..... B41J 2/175 347/63

FOREIGN PATENT DOCUMENTS

JP 2008-194982 8/2008
JP 2011-218784 11/2011

* cited by examiner

*Primary Examiner* — Huan Tran
*Assistant Examiner* — Alexander D Shenderov
(74) *Attorney, Agent, or Firm* — Cooper & Dunham LLP

(57) ABSTRACT

A liquid discharge head includes a plurality of nozzles, a plurality of individual liquid chambers, a plurality of liquid delivery channels, and a deformation unit. The plurality of nozzles discharges liquid. The plurality of individual liquid chambers is communicated with the plurality of nozzles. The plurality of liquid delivery channels is communicated with the plurality of individual liquid chambers. Each of the plurality of liquid delivery channels includes a channel portion at a partition wall between adjacent individual liquid chambers of the plurality of individual liquid chambers. The deformation unit deforms at least a portion of the channel portion.

13 Claims, 20 Drawing Sheets

DRIVE WAVEFORM PV

FLOW-AMOUNT CONTROL WAVEFORM PS

DRIVE WAVEFORM PV

FLOW-AMOUNT CONTROL WAVEFORM PS

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2016-039433 filed on Mar. 1, 2016 and 2016-252475 filed on Dec. 27, 2016 in the Japan Patent Office, the entire disclosure of each of which is hereby incorporated by reference herein.

BACKGROUND

Technical Field

Aspects of the present disclosure relate to a liquid discharge head, a liquid discharge device, and a liquid discharge apparatus.

Related Art

As a liquid discharge head (droplet discharge head) to discharge liquid, for example, a circulation-type head is known. In the circulation-type head, of the liquid supplied to an individual liquid chamber, liquid having not been discharged is returned and circulated from a liquid delivery channel to a circulation common liquid chamber to enhance the performance of discharging bubbles having entered the individual liquid chamber and reduce change in properties of liquid.

SUMMARY

In an aspect of the present disclosure, there is provided a liquid discharge head that includes a plurality of nozzles, a plurality of individual liquid chambers, a plurality of liquid delivery channels, and a deformation unit. The plurality of nozzles discharges liquid. The plurality of individual liquid chambers is communicated with the plurality of nozzles. The plurality of liquid delivery channels is communicated with the plurality of individual liquid chambers. Each of the plurality of liquid delivery channels includes a channel portion at a partition wall between adjacent individual liquid chambers of the plurality of individual liquid chambers. The deformation unit deforms at least a portion of the channel portion.

In another aspect of the present disclosure, there is provided a liquid discharge device that includes the liquid discharge head to discharge the liquid.

In still another aspect of the present disclosure, there is provided a liquid discharge apparatus that includes the liquid discharge device to discharge the liquid.

In still yet another aspect of the present disclosure, there is provided a liquid discharge apparatus that includes the liquid discharge head to discharge the liquid.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
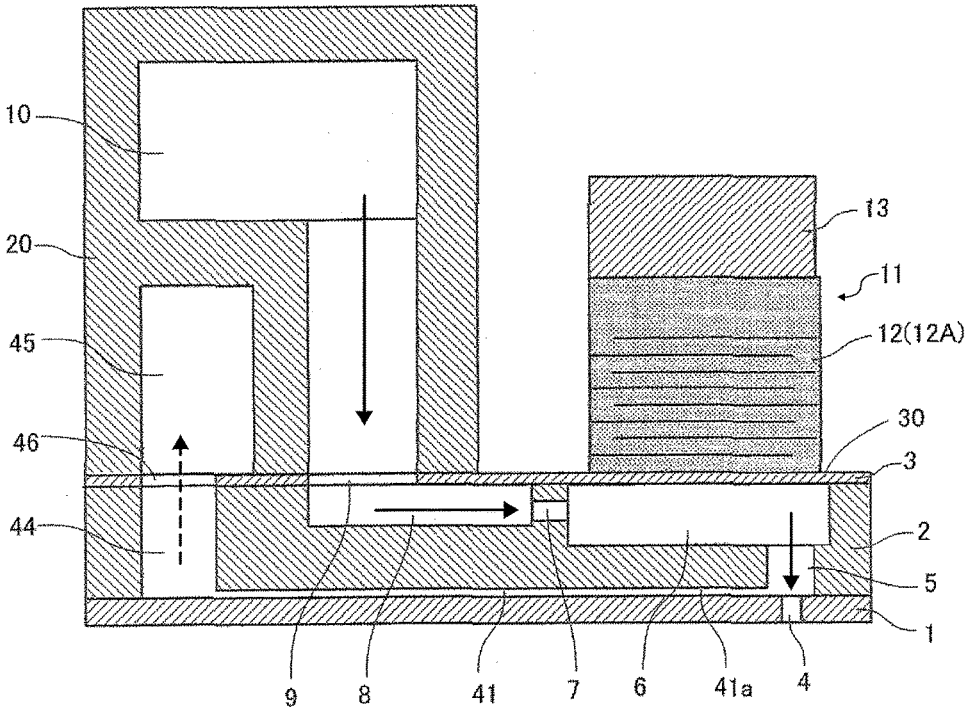
FIG. 1 is a cross-sectional view of a liquid discharge head according to a first embodiment of the present disclosure, cut in a direction (a longitudinal direction of individual liquid chamber) perpendicular to a nozzle array direction in which nozzles are arrayed in row.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
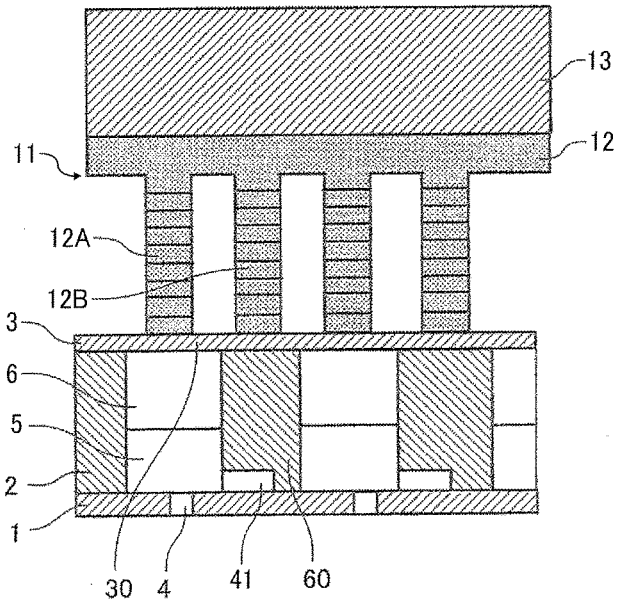
FIG. 2 is a cross-sectional view of the liquid discharge head of FIG. 1 in a cross section B-B of FIG. 3 cut in the nozzle array direction (a transverse direction of individual liquid chamber)
Figure 3:
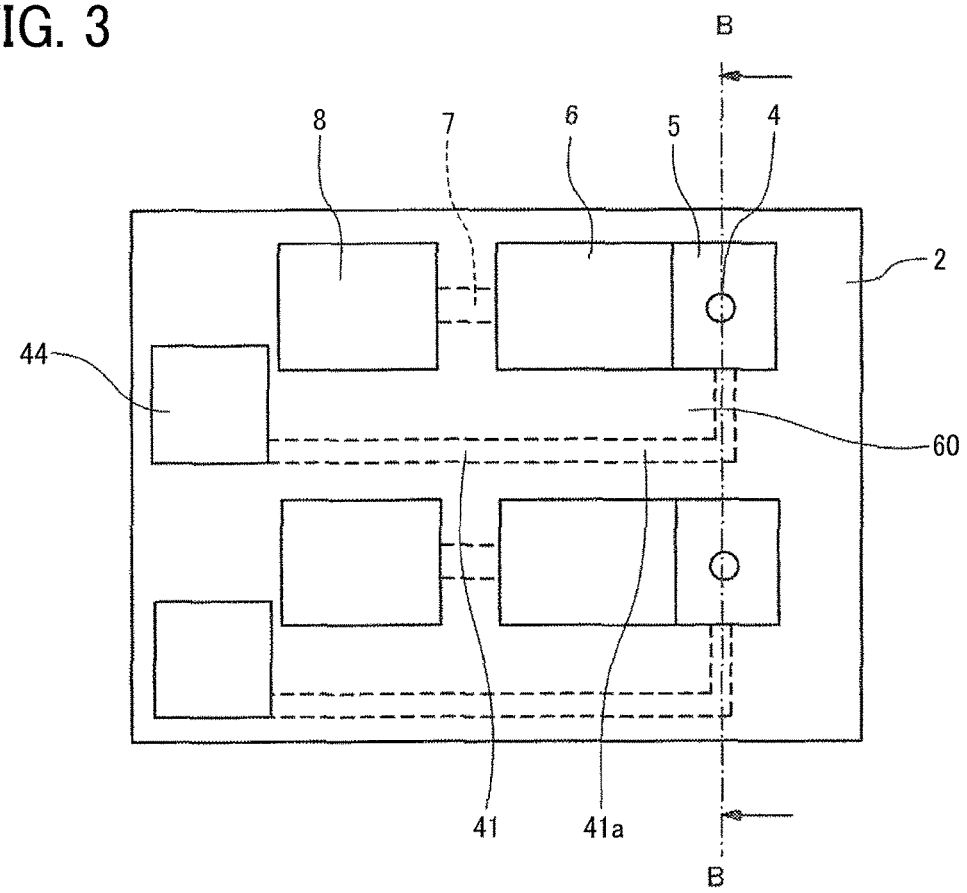
FIG. 3 is a plan view of a channel plate of FIG. 1 seen from the side of a diaphragm plate.

Below, embodiments of the present disclosure are described with reference to the attached drawings. A liquid discharge head according to a first embodiment of the present disclosure is described with reference to FIGS. 1 to 3. FIG. 1 is a cross-sectional view of the liquid discharge head according to the first embodiment cut in a direction (a longitudinal direction of individual liquid chamber) perpendicular to a nozzle array direction in which nozzles are arrayed in row. FIG. 2 is a cross-sectional view of the liquid discharge head of FIG. 1 in a cross section B-B of FIG. 3 cut in the nozzle array direction (a transverse direction of individual liquid chamber). FIG. 3 is a plan view of a channel plate of FIG. 1 seen from the side of a diaphragm plate.

A liquid discharge head 404 according to the first embodiment of the present disclosure includes a nozzle plate 1, a channel plate 2, and a diaphragm plate 3 as a wall member that are laminated one on another and bonded to each other. The liquid discharge head 404 includes piezoelectric actuators 11 to displace the diaphragm plate 3 and a frame member 20 as a common-liquid-chamber substrate.

The nozzle plate 1 includes a plurality of nozzles 4 to discharge liquid. In the present embodiment, the liquid discharge head 404 includes two nozzle rows, in which the plurality of nozzles 4 is arrayed in two rows (in FIG. 2, nozzles of one of the two nozzle rows are illustrated.)

The channel plate 2 includes through-holes and grooves that constitute nozzle communication channels 5 communicated with the nozzles 4, individual liquid chambers 6 communicated with the nozzles 4 via the nozzle communication channels 5, fluid restrictors 7 communicated with the individual liquid chambers 6, and liquid introduction portions 8 communicated with the fluid restrictors 7. The nozzle communication channel 5 is a flow channel continuous and communicated with each of the nozzle 104 and the individual liquid chamber 106. The fluid restrictor 7 and the liquid introduction portion 8 constitutes a liquid supply channel.

The diaphragm plate 3 includes deformable vibration portions 30 constituting wall faces of the individual liquid chambers 6 of the channel plate 2.

At a first side of the diaphragm plate 3 opposite a second side of the diaphragm plate 3 facing the individual liquid chambers 6, the piezoelectric actuators 11 including electromechanical transducer elements as drivers (actuators or pressure generators) are disposed to deform the diaphragm plate 3.

The piezoelectric actuator 11 includes a plurality of piezoelectric elements (piezoelectric pillars) 12A and 12B being pillar-shaped electromechanical transducer elements arranged at certain distances in the nozzle array direction. The piezoelectric elements 12A are bonded to the vibration portions 30.

The frame member 20 includes the common liquid chambers 10 to which liquid is supplied from head tanks and liquid cartridges.

The channel plate 2 includes liquid delivery channels 41 at a nozzle plate 1 side (a side facing the nozzle plate 1) opposite an individual liquid chamber 6 side (a side facing the individual liquid chamber 6). The liquid delivery channel 41 constitutes a circulation channel communicated with the nozzle communication channel 5. Each liquid delivery channel 41 is communicated with a common liquid chamber 45 of the frame member 20 via a passage 44 penetrating through the channel plate 2 and an opening 46 of the diaphragm plate 3.

In the liquid discharge head 404 thus configured, for example, when a voltage lower than a reference potential is applied to the piezoelectric element 12A, the piezoelectric element 12A contracts. Accordingly, the vibration portion 30 of the diaphragm plate 3 is pulled and the volume of the individual liquid chamber 6 increases, thus causing liquid to flow into the individual liquid chamber 6.

When the voltage applied to the piezoelectric element 12A is raised, the piezoelectric element 12A extends in a direction of lamination in which the laminated piezoelectric members of the piezoelectric element 12A are laminated one on another. Accordingly, the diaphragm plate 3 deforms in a direction toward the nozzle 4 and the volume of the individual liquid chamber 6 reduces. Thus, liquid in the individual liquid chamber 6 is pressurized and discharged from the nozzle 4.

When the voltage applied to the piezoelectric element 12A is returned to the reference potential, the vibration portion 30 of the diaphragm plate 3 is returned to the initial position. Accordingly, the individual liquid chamber 6 expands to generate a negative pressure, thus replenishing liquid from the common liquid chamber 10 into the individual liquid chamber 6. After the vibration of a meniscus surface of the nozzle 4 decays to a stable state, the liquid discharge head 404 shifts to an operation for the next droplet discharge.

Note that the driving method of the liquid discharge head is not limited to the above-described example (pull-push discharge). For example, pull discharge or push discharge may be performed in response to the way to apply the drive waveform.

When the liquid discharge head is used, liquid is constantly circulated to flow the liquid to the liquid delivery channels 41 regardless of whether the operation of discharging liquid from the nozzle 4 is performed.

In the present embodiment, as illustrated in FIGS. 2 and 3, the liquid delivery channel 41 at the nozzle plate 1 side of the channel plate 2 includes a channel portion 41*a* at a partition wall 60 between adjacent individual liquid chambers 6.

By contrast, the piezoelectric element 12B of the piezoelectric actuator 11 is bonded to the diaphragm plate 3 and linked to the partition wall 60 at a position corresponding to the partition wall 60 between adjacent individual liquid chambers 6.

Accordingly, the partition wall 60 can be deformed by driving the piezoelectric elements 12B. In other words, the piezoelectric elements 12B being the electromechanical transducer element constitutes a deformation unit to deform the channel portions 41*a* of the liquid delivery channel 41. The piezoelectric element 12B is disposed adjacent to the piezoelectric element 12A being the electromechanical transducer element to pressurize the individual liquid chamber 6.

Figure 4:
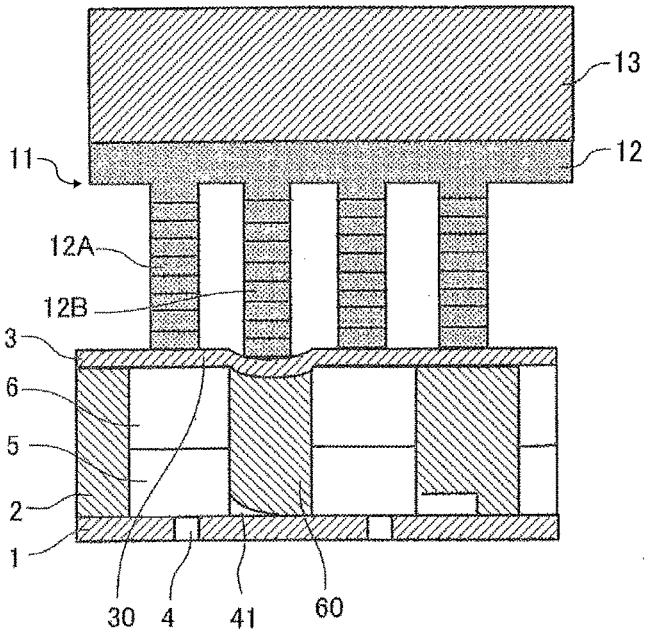
FIG. 4 is a cross-sectional view of the liquid discharge head along the nozzle array direction.

Next, a control operation of the flow amount of the liquid delivery channel in the present embodiment is described with reference to FIG. 4. FIG. 4 is a cross-sectional view of the liquid discharge head along the nozzle array direction.

As a method of driving the piezoelectric elements 12B to control the flow amount of the liquid delivery channel 41, for example, a first drive control method is used of reducing the cross-sectional open area (the cross-sectional area in the direction perpendicular to the direction of flow of liquid) of the channel portion 41*a* of the liquid delivery channel 41 to increase the resistance to fluid. In addition, a second drive control method is used of deforming the channel portion 41*a* of the liquid delivery channel 41 once or more to generate a pressure wave toward the entry side.

For the first drive control method, as illustrated in FIG. 4, the partition wall 60 is pressed and deformed toward the nozzle plate 1 by driving the piezoelectric element 12B to extend. Accordingly, the cross-sectional open area of the channel portion 41*a* of the liquid delivery channel 41 decreases and the fluid resistance of the channel portion 41*a* increases.

Hence, when the piezoelectric element 12A is driven to discharge liquid from the nozzle 4, the piezoelectric elements 12B is driven to extend to increase the fluid resistance of the channel portion 41*a* of the liquid delivery channel 41, thus reducing liquid escaping from the nozzle communication channel 5 to the liquid delivery channel 41.

Accordingly, the pressure of the piezoelectric element 12A is effectively used, thus suppressing a reduction in discharge efficiency.

For the second drive control method, by driving the piezoelectric elements 12B to extend and contract, deformation of the partition wall 60 is repeated to vibrate the wall face of the channel portion 41*a* of the liquid delivery channel 41. Accordingly, liquid in the channel portion 41*a* is vibrated, thus generating a pressure wave from the channel portion 41*a* toward the entry side (in the present embodiment, the nozzle communication channel 5) of the liquid delivery channel 41. Note that the pressure wave toward the entry side can be generated by deforming the channel portion 41*a* of the liquid delivery channel 41 once or more.

At this time, by controlling the drive timing of the piezoelectric elements 12B, the pressure wave can be generated from the channel portion 41*a* toward the entry side of the liquid delivery channel 41 when liquid in the individual liquid chamber 6 is pressurized. The pressure wave reduces liquid escaping from the nozzle communication channel 5 to the liquid delivery channel 41.

Accordingly, the pressure of the piezoelectric element 12A is effectively used, thus suppressing a reduction in discharge efficiency.

By contrast, when liquid is not discharged from the nozzle 4, the piezoelectric element 12B is inactivated so as not to increase the fluid resistance of the channel portion 41*a* of the liquid delivery channel 41 or generate the pressure wave at the channel portion 41*a* of the liquid delivery channel 41.

Such a configuration can smoothly deliver liquid to the common liquid chamber 45 through the liquid delivery channel 41 for circulation, thus reducing a change in viscosity, such as thickening, in the nozzle 4.

Figure 5:
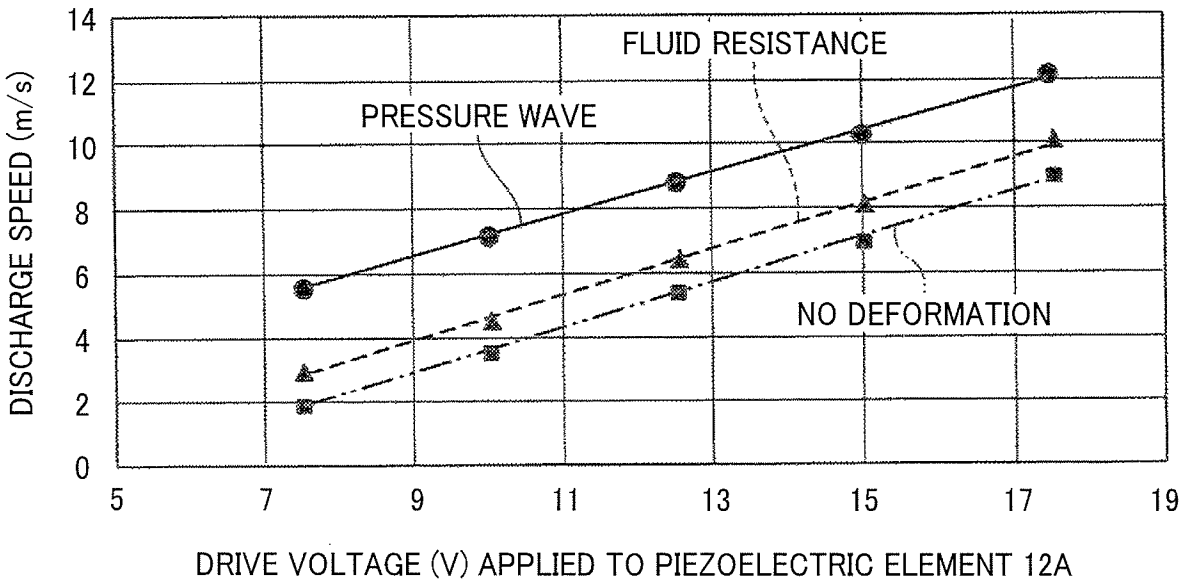
FIG. 5 is a graph of an example of the relationship between the drive voltage of drive waveform for discharging liquid and the discharge speed in the cases in which the control of the flow amount of the liquid delivery channel is performed and not performed.

Here, with reference to FIG. 5, a description is given of an example of the relationship between the drive voltage of drive waveform for discharging liquid and the discharge speed in the cases in which the control of the flow amount of the liquid delivery channel is performed and not performed. FIG. 5 is a graph of an example of the relationship.

When a drive waveform for discharge is applied to the piezoelectric element 12A to discharge liquid, the drive voltage of the drive waveform for discharge was changed and the discharge speed was measured for (a) when the piezoelectric element 12B is not driven (non-driving), (b) when the piezoelectric element 12B is driven to extend and contract to increase the fluid resistance (fluid resistance), and (c) when the piezoelectric element 12B is driven to extend and contract to generate the pressure wave (pressure wave). Results are shown in FIG. 5.

As seen from FIG. 5, for the configuration in which the piezoelectric element 12B is driven to increase the fluid resistance or generate a pressure wave, the discharge speed is higher and the discharge efficiency is higher than in the configuration in which the piezoelectric element 12B is not driven, in other words, the liquid discharge head has no means to deform the channel portion of the liquid delivery channel.

When the piezoelectric element 12B is driven to generate a pressure wave, the discharge speed is higher and the discharge efficiency is more enhanced than when the piezoelectric element 12B is driven to increase the fluid resistance.

Figure 6:
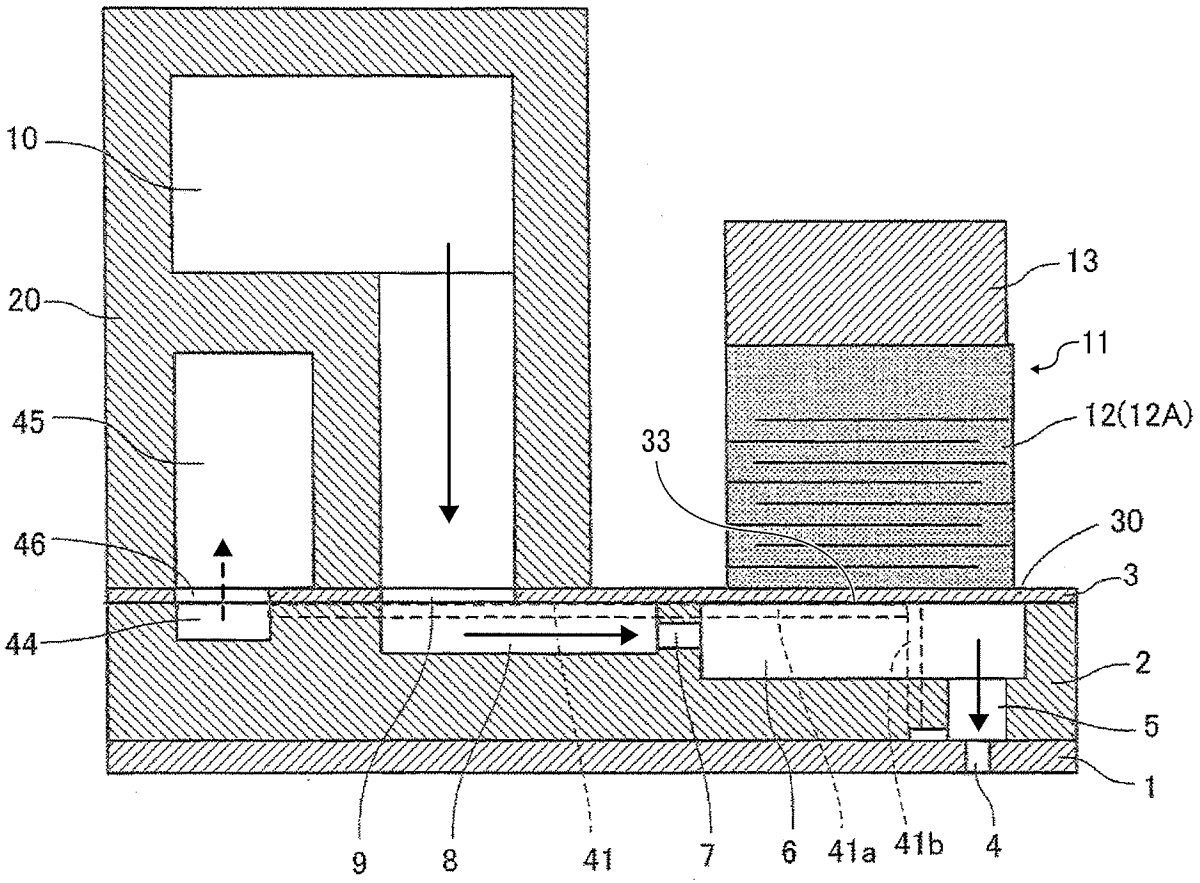
FIG. 6 is a cross-sectional view of the liquid discharge head according to a second embodiment of the present disclosure, cut in the direction (the longitudinal direction of individual liquid chamber) perpendicular to the nozzle array direction.
Figure 7:
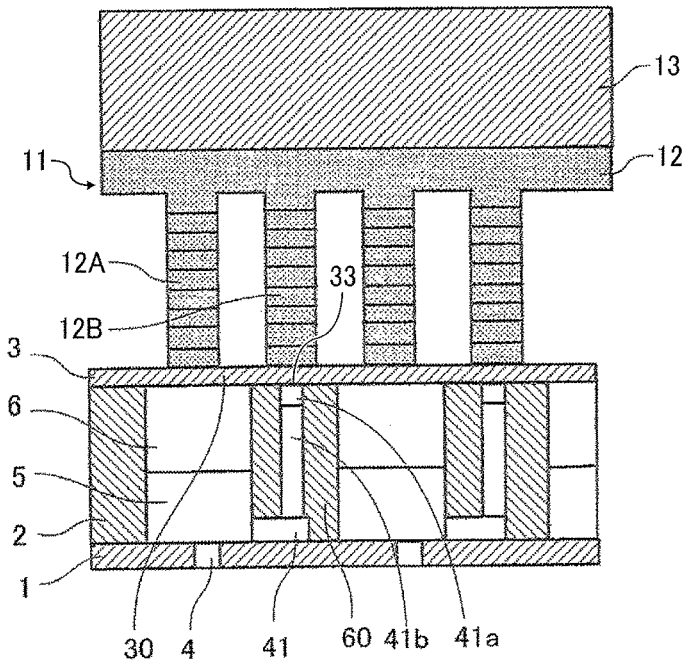
FIG. 7 is a cross-sectional view of the liquid discharge head of FIG. 6 in a cross section B-B of FIG. 8 cut in the nozzle array direction (the transverse direction of individual liquid chamber)
Figure 8:
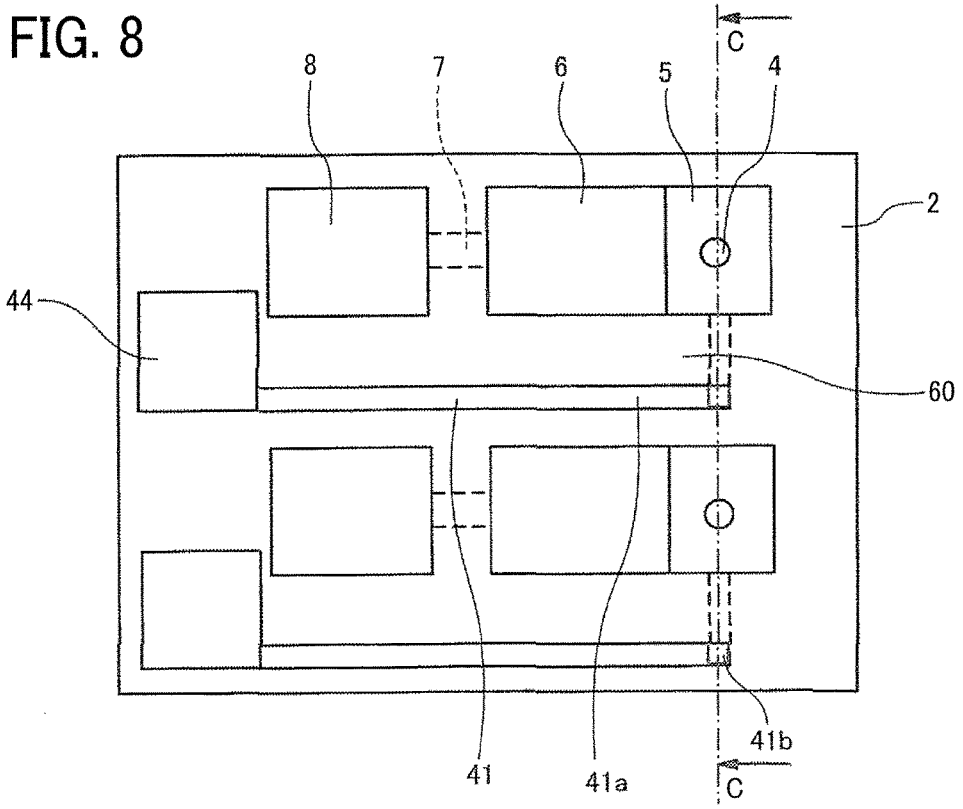
FIG. 8 is a plan view of a channel plate of FIG. 6 seen from the side of a diaphragm plate.

Next, the liquid discharge head according to a second embodiment of the present disclosure is described with reference to FIGS. 6 to 8. FIG. 6 is a cross-sectional view of the liquid discharge head according to the second embodiment cut in the direction (the longitudinal direction of individual liquid chamber) perpendicular to the nozzle array direction. FIG. 7 is a cross-sectional view of the liquid discharge head of FIG. 6 in a cross section B-B of FIG. 8 cut in the nozzle array direction (a transverse direction of individual liquid chamber). FIG. 8 is a plan view of a channel plate of FIG. 6 seen from the side of a diaphragm plate.

In the present embodiment, the liquid delivery channel 41, which is open to the nozzle communication channel 5 at the nozzle plate 1 side of the channel plate 2, is lead to the diaphragm plate 3 side via a channel portion 41*b* extending in the direction of thickness of the channel plate 2 and is communicated with the passage 44 via the channel portion 41*a*, which is disposed at the diaphragm plate 3 side of the partition wall 60.

Here, the channel portion 41*a* of the liquid delivery channel 41 includes a wall surface 33 deformable at the diaphragm plate 3.

The piezoelectric element 12B corresponding to the partition wall 60 between adjacent individual liquid chambers 6 is bonded and linked to the deformable wall surface 33 of the channel portion 41*a*.

Accordingly, the wall surface 33 of the channel portion 41*a* of the liquid delivery channel 41 can be deformed by driving the piezoelectric element 12B. In other words, the piezoelectric elements 12B being the electromechanical transducer element constitutes a deformation unit to deform the channel portions 41*a* of the liquid delivery channel 41.

Figure 9:
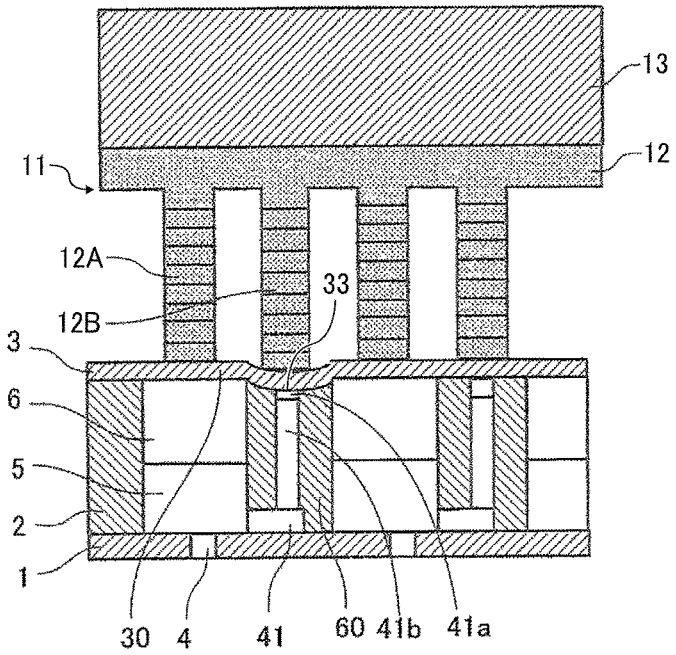
FIG. 9 is a cross-sectional view of the liquid discharge head along the nozzle array direction.

Next, a control operation of the flow amount of the liquid delivery channel in the present embodiment is described with reference to FIG. 9. FIG. 9 is a cross-sectional view of the liquid discharge head along the nozzle array direction.

In the present embodiment, similarly with the above-described first embodiment, as a method of driving the piezoelectric element 12B to control the flow amount of the liquid delivery channel 41, a first drive control method is used of increasing the fluid resistance of the channel portion 41*a* of the liquid delivery channel 41. In addition, a second drive control method is used of vibrating the wall surface 33 of the channel portion 41*a* of the liquid delivery channel 41 to generate a pressure wave toward the entry side.

For the first drive control method, as illustrated in FIG. 9, the wall surface 33 is pressed and deformed toward the channel portion 41*a* by driving the piezoelectric element 12B to extend. Accordingly, the cross-sectional open area of the channel portion 41*a* of the liquid delivery channel 41 decreases and the fluid resistance of the channel portion 41*a* increases.

Hence, when the piezoelectric element 12A is driven to discharge liquid from the nozzle 4, the piezoelectric elements 12B is driven to extend to increase the fluid resistance of the channel portion 41*a* of the liquid delivery channel 41, thus reducing liquid escaping from the nozzle communication channel 5 to the liquid delivery channel 41.

Accordingly, the pressure of the piezoelectric element 12A is effectively used, thus suppressing a reduction in discharge efficiency.

For the second drive control method, by driving the piezoelectric elements 12B to extend and contract, deformation of the wall surface 33 of the channel portion 41*a* is repeated to vibrate the wall face of the channel portion 41*a* of the liquid delivery channel 41. Accordingly, liquid in the channel portion 41*a* is vibrated, thus generating a pressure wave from the channel portion 41*a* toward the entry side (in the present embodiment, the nozzle communication channel 5) of the liquid delivery channel 41.

At this time, by controlling the drive timing of the piezoelectric elements 12B, the pressure wave can be generated from the channel portion 41*a* toward the entry side of the liquid delivery channel 41 when liquid in the individual liquid chamber 6 is pressurized. The pressure wave reduces liquid escaping from the nozzle communication channel 5 to the liquid delivery channel 41.

Accordingly, the pressure of the piezoelectric element 12A is effectively used, thus suppressing a reduction in discharge efficiency.

By contrast, when liquid is not discharged from the nozzle 4, the piezoelectric element 12B is inactivated so as not to increase the fluid resistance of the channel portion 41*a* of the liquid delivery channel 41 or generate the pressure wave at the channel portion 41*a* of the liquid delivery channel 41.

Such a configuration can smoothly deliver liquid to the common liquid chamber 45 through the liquid delivery channel 41 for circulation, thus reducing a change in viscosity, such as thickening, in the nozzle 4.

Figure 10:
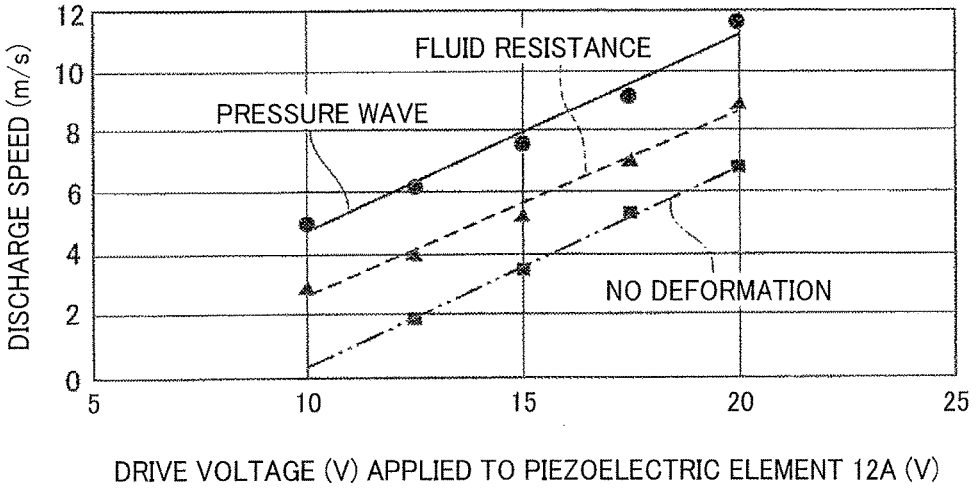
FIG. 10 is a graph of another example of the relationship between the drive voltage of drive waveform for discharging liquid and the discharge speed in the cases in which the control of the flow amount of the liquid delivery channel is performed and not performed.

Here, with reference to FIG. 10, a description is given of an example of the relationship between the drive voltage of drive waveform for discharging liquid and the discharge speed in the cases in which the control of the flow amount of the liquid delivery channel is performed and not performed. FIG. 10 is a graph of an example of the relationship.

When a drive waveform for discharge is applied to the piezoelectric element 12A to discharge liquid, the drive voltage of the drive waveform for discharge was changed and the discharge speed was measured for (a) when the piezoelectric element 12B was not driven (non-driving), (b) when the piezoelectric element 12B was driven to extend and contract to increase the fluid resistance (fluid resistance), and (c) when the piezoelectric element 12B was driven to extend and contract to generate the pressure wave (pressure wave). Results are shown in FIG. 10.

As seen from FIG. 10, for the configuration in which the piezoelectric element 12B is driven to increase the fluid resistance or generate a pressure wave, the discharge speed is higher and the discharge efficiency is higher than in the configuration in which the piezoelectric element 12B is not driven, in other words, the liquid discharge head has no means to deform the channel portion of the liquid delivery channel.

When the piezoelectric element 12B is driven to generate a pressure wave, the discharge speed is higher and the discharge efficiency is more enhanced than when the piezoelectric element 12B is driven to increase the fluid resistance.

Figure 11:
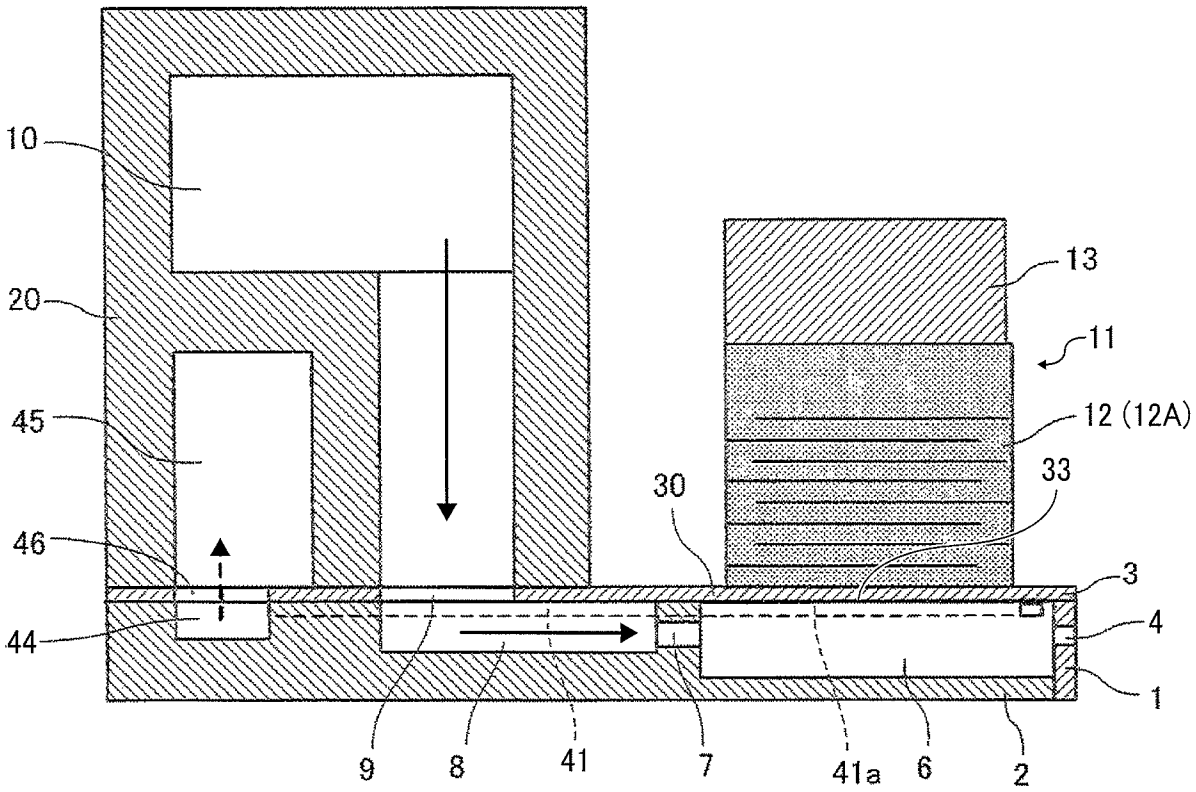
FIG. 11 is a cross-sectional view of the liquid discharge head according to a third embodiment of the present disclosure, cut in the direction (the longitudinal direction of individual liquid chamber) perpendicular to the nozzle array direction.

Next, a third embodiment of the present disclosure is described with reference to FIG. 11. FIG. 11 is a cross-sectional view of the liquid discharge head according to the third embodiment, cut in the direction (the longitudinal direction of individual liquid chamber) perpendicular to the nozzle array direction.

In the present embodiment, the nozzles 4 are disposed at positions at which liquid are discharged in the direction of flow of liquid in the individual liquid chambers 6.

The liquid delivery channel 41 is open at a side wall surface of the nozzle 4 side of the individual liquid chamber 6. In the present embodiment, similarly with the above-described first embodiment, a channel portion of the liquid delivery channel 41 is disposed at the nozzle plate 1 side of a partition wall. Note that, similarly with the above-described second embodiment, the liquid delivery channel 41 may be disposed at the diaphragm plate 3 side to form a deformable wall surface.

Such a head configuration can achieve operation effects equivalent to the operation effects of each of the above-described embodiments.

Figure 12:
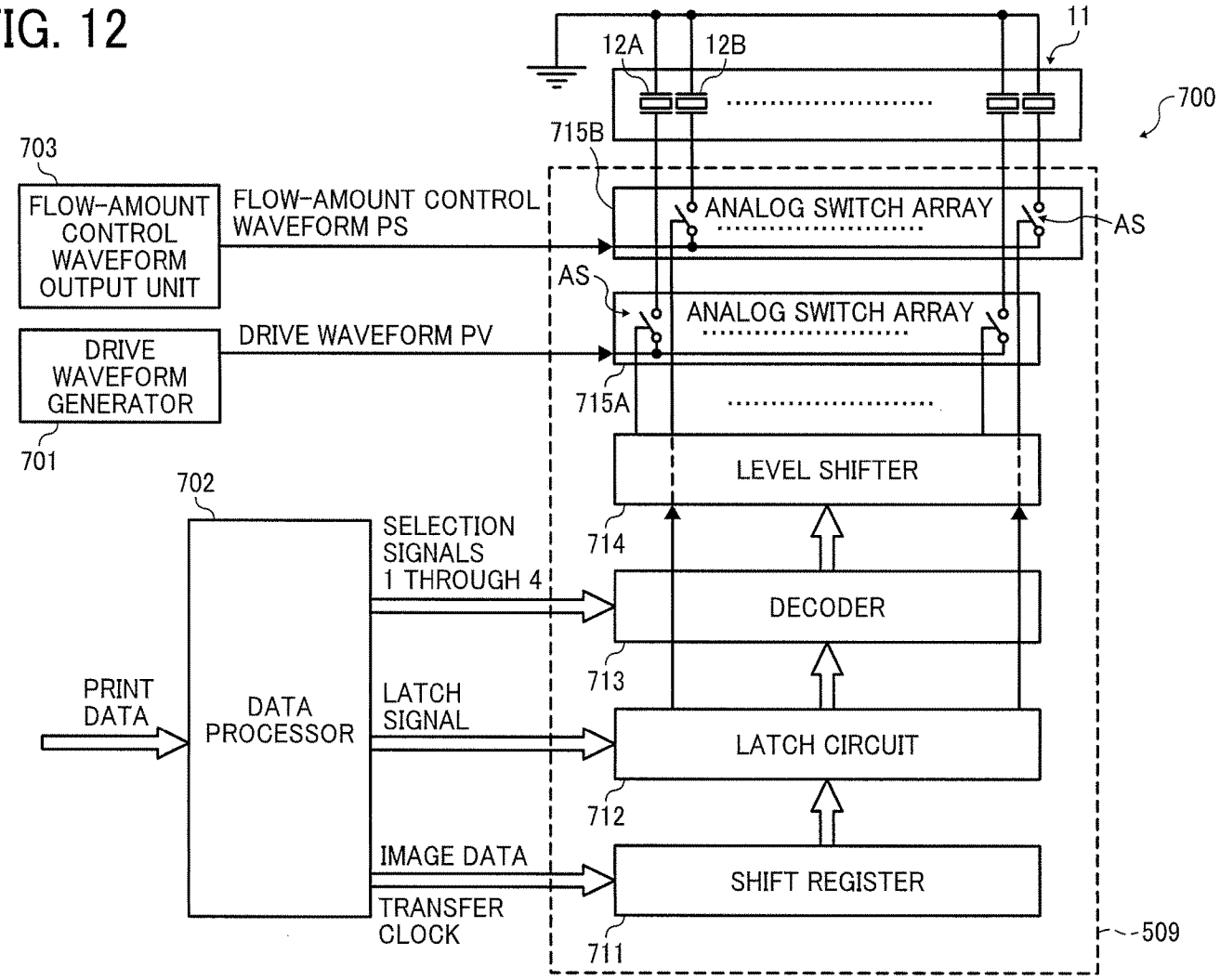
FIG. 12 is a block diagram of a first example of a head drive control device to control driving of the liquid discharge head according to any embodiment of the present disclosure.
Figure 13A:
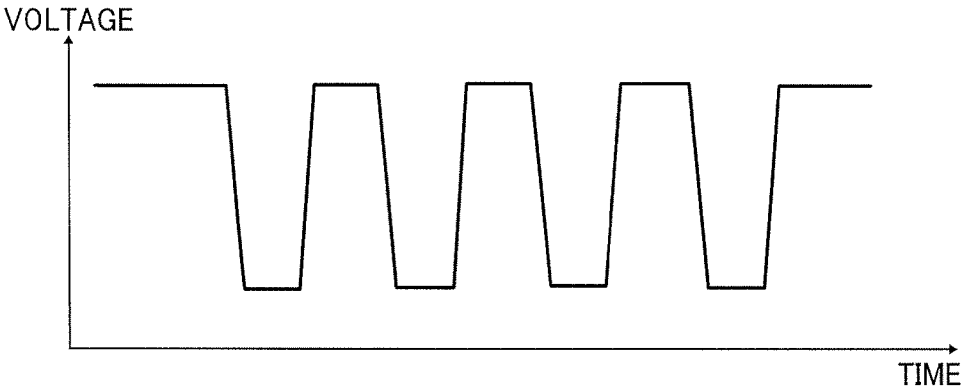
FIGS. 13A and 13B are illustrations of an example of drive waveform and flow-amount control waveform in the first example.
Figure 13B:
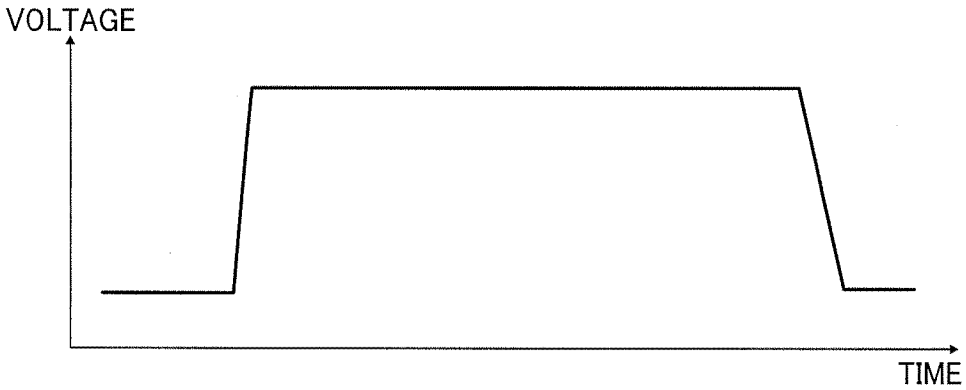

Next, with reference to FIGS. 12, 13A, and 13B, a description is given of a first example of a head drive control device being a drive controller to control driving of the liquid discharge head according to any of the above-described embodiments. FIG. 12 is a block diagram of the first example of the head drive control device 700. FIGS. 13A and 13B are illustrations of an example of drive waveform and flow-amount control waveform.

The driving waveform generator 701 generates a drive waveform PV, which includes one or more drive pulses to discharge liquid, applied to the piezoelectric element 12A of the liquid discharge head. For example, as illustrated in FIG. 13A, the driving waveform generator 701 generates and outputs the drive waveform PV including a plurality of drive pulses in a single drive cycle.

The driving waveform generator 701 includes, for example, a storage device to store and retain data of the drive waveform PV, a digital-analog (D/A) converter to read data of the drive waveform PV to perform D/A conversion, and an amplifier to perform current amplification and voltage amplification on a signal of the converted drive waveform.

A flow-amount control waveform output unit 703 generates and outputs a flow-amount control waveform PS that is applied to the piezoelectric element 12B of the liquid discharge head to deform the channel portion 41*a* of the liquid delivery channel 41.

As illustrated in FIG. 13B, the flow-amount control waveform output unit 703 generates and outputs the flow-amount control waveform PS, which is a voltage waveform rises from the start of output of the drive waveform PV and falls at the end of output of the drive waveform PV.

Similarly with the driving waveform generator 701, the flow-amount control waveform output unit 703 also includes, for example, a storage device to store and retain data of the flow-amount control waveform PS, a digital-analog (D/A) converter to read data of the flow-amount control waveform PS to perform D/A conversion, and an amplifier to perform current amplification and voltage amplification on a signal of the converted drive waveform. Note that the flow-amount control waveform output unit 703 may be constituted with a switching unit to simply turn the input voltage on at the start of one drive cycle and off at the end of the drive cycle.

A data processing unit 702 receives print data, perform data processing on the print data, and outputs two-bit image data (gradation signals 0 and 1), a clock signal, a latch signal, and selection signals (droplet control signal) to select a drive pulse(s) constituting the drive waveform PV.

The selection signals instruct opening and closing of an analog switch AS for each droplet. The analog switch AS is a switching unit of the head driver 509. The selection signals transit the states to the level H (ON) for a drive pulse (or waveform element) to be selected and to the level L (OFF) for a driving pulse not to be selected in accordance with a printing period of the drive waveform PV.

The head driver 509 includes a shift register 711, a latch circuit 712, a decoder 713, a level shifter 714, an analog switch array 715A, and an analog switch array 715B.

To the shift register 711, transfer clock (shift clock) and serial image data (gradation data: two bits per channel (one nozzle)) are input from the data processing unit 702. The latch circuit 712 latches each resist value of the shift register 711 corresponding to latch signals.

The decoder 713 decodes the gradation data and the selection signals to output the result of decoding. The level shifter 714 performs level conversion of the voltage signals of the decoder 713 at a logic level to a level at which the analog switches AS of the analog switch arrays 715A and 715B are operable.

The analog switches AS of the analog switch arrays 715A and 715B are turned on and off (opened and closed) according to the output from the decoder 713 provided through the level shifter 714.

The analog switch AS of the analog switch array 715A is connected to the individual electrode of the piezoelectric element 12A, and the drive waveform PV from the drive waveform generator 701 is input to the analog switch AS.

Thus, the analog switch AS is turned on and off according to the results of decoding the image data (gradation data) and the selection signals, which have been serially transferred, by the decoder 713. Thus, drive pulses (or waveform elements) constituting the drive waveform PV pass (are selected) and are supplied to the piezoelectric element 12A to discharge liquid.

The analog switch AS of the analog switch array 715B is connected to the individual electrode of the piezoelectric element 12B, and the flow-amount control waveform PS from the flow-amount control waveform output unit 703 is input to the analog switch AS.

The analog switch AS of the analog switch array 715B is turned on and off according to latch data of the latch circuit 712 corresponding to the piezoelectric element 12A to pressurize the individual liquid chamber 6 communicated with the liquid delivery channel 41 to be deformed with the piezoelectric element 12B.

Accordingly, for the nozzle 4 to discharge liquid, during one drive cycle, the flow-amount control waveform PS is applied to the piezoelectric element 12B and the piezoelectric element 12B is extended, thus increasing the fluid resistance of the channel portion 41*a*.

Figure 14:
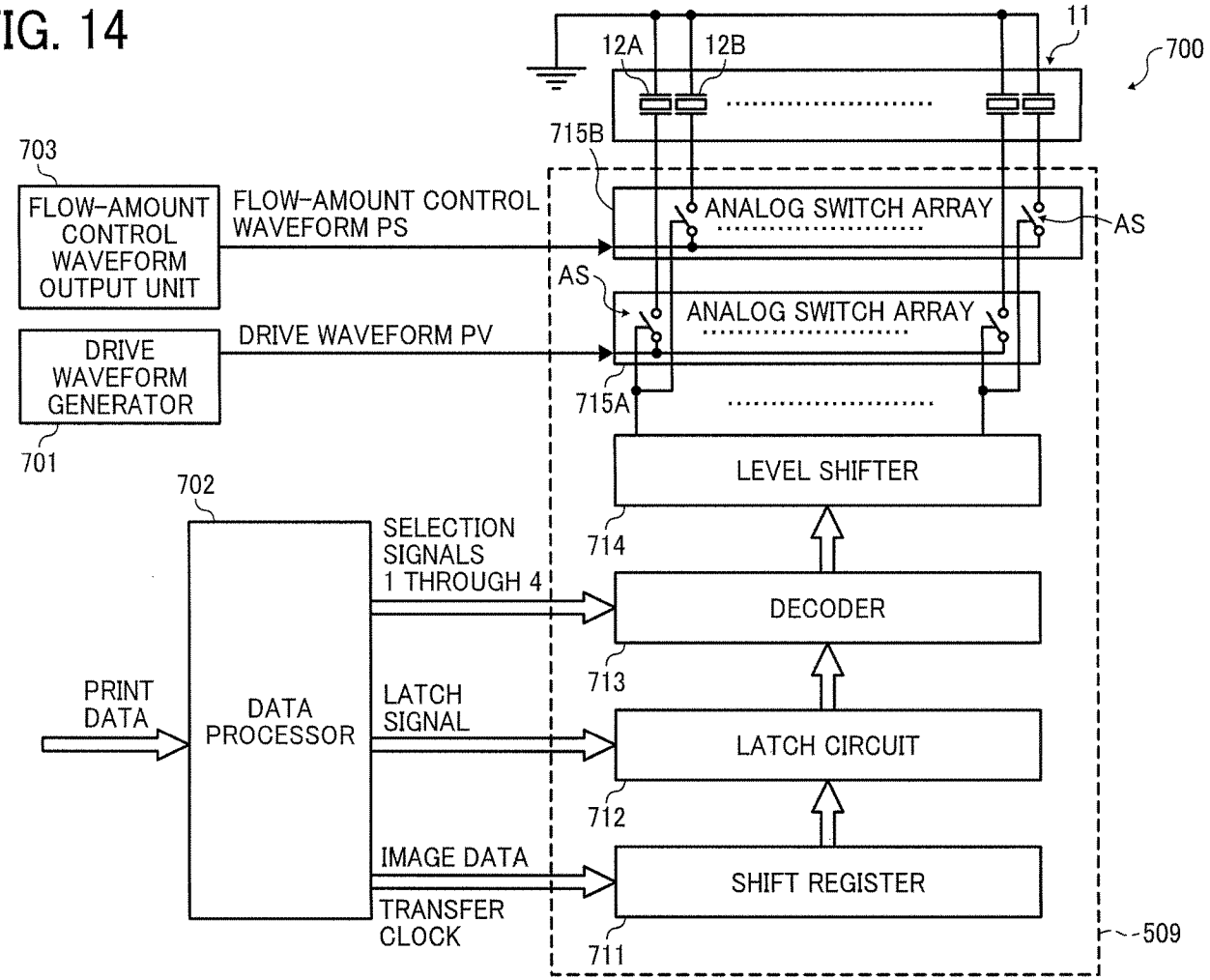
FIG. 14 is a block diagram of a second example of the head drive control device to control driving of the liquid discharge head according to any embodiment of the present disclosure.
Figure 15A:
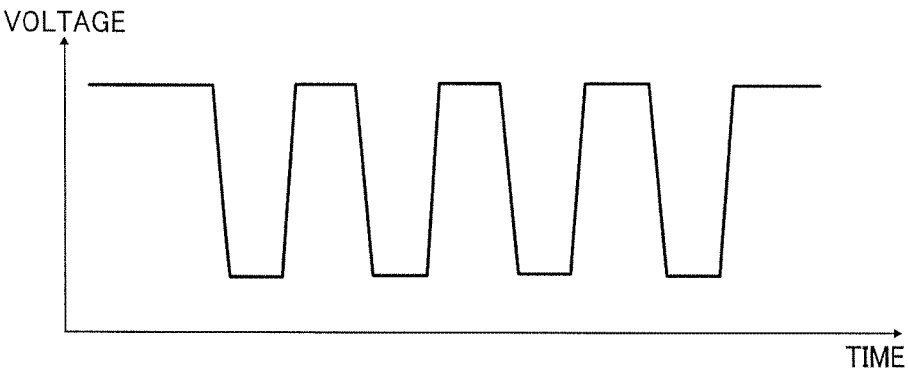
FIGS. 15A and 15B are illustrations of an example of drive waveform and flow-amount control waveform in the second example.
Figure 15B:
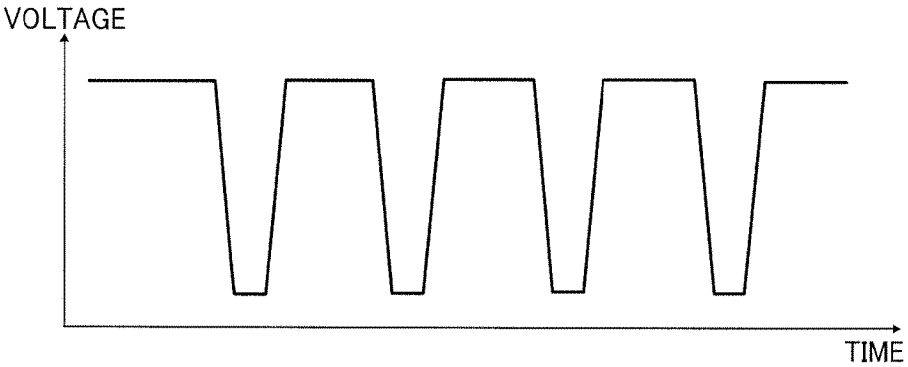

Next, with reference to FIGS. 14, 15A, and 15B, a description is given of a second example of the head drive control device to control driving of the liquid discharge head according to any of the above-described embodiments. FIG. 14 is a block diagram of the head drive control device 700. FIGS. 15A and 15B are illustrations of an example of drive waveform and flow-amount control waveform.

In the present embodiment, similarly with the above-described first example, for example, as illustrated in FIG. 15A, the driving waveform generator 701 generates and outputs the drive waveform PV including a plurality of drive pulses in a single drive cycle.

As the flow-amount control waveform PS applied to the piezoelectric element 12B of the liquid discharge head to deform the channel portion 41*a* of the liquid delivery channel 41, for example, as illustrated in FIG. 15B, the flow-amount control waveform PS including a drive pulse synchronous with the drive pulse of the drive waveform PV. The term "synchronous" used here represents that, when the piezoelectric element 12A is extended with a drive pulse of the drive waveform PV to contract the individual liquid chamber 6, the piezoelectric element 12B is also extended in a direction in which the piezoelectric element 12B contracts the channel portion 41*a* of the liquid delivery channel 41.

In the present embodiment, the analog switch AS of the analog switch array 715B is turned on and off according to results of decoding applied to the piezoelectric element 12A to pressurize the individual liquid chamber 6 communicated with the liquid delivery channel 41 to be deformed with the piezoelectric element 12B.

Accordingly, for the nozzle 4 to discharge liquid, when the drive pulse of the drive waveform PV is applied, the drive pulse of the flow-amount control waveform PS is also selected and applied to the piezoelectric element 12B, the piezoelectric element 12B is extended to generate a pressure wave from the channel portion 41*a* toward the entry of the liquid delivery channel 41.

Figure 16:
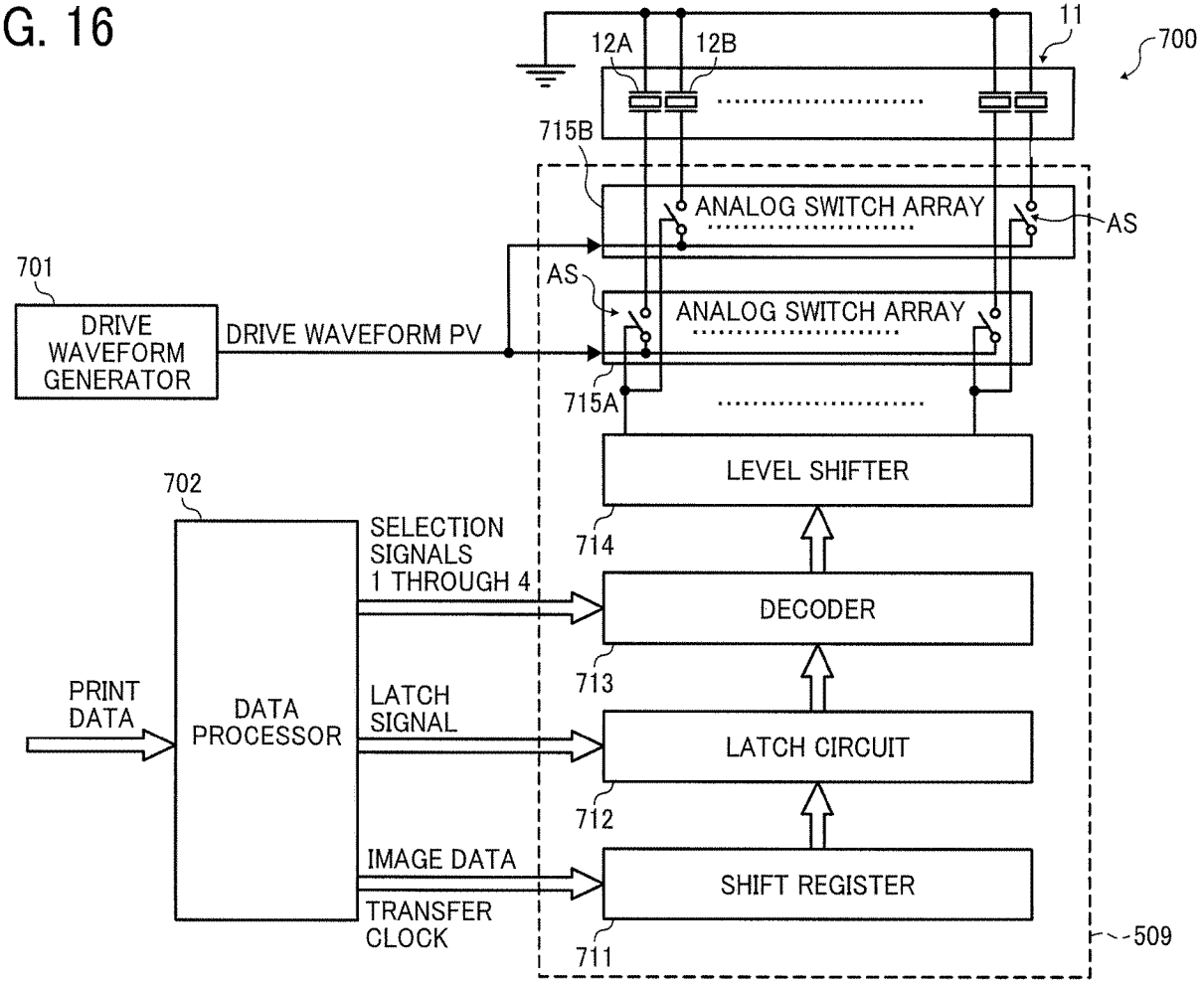
FIG. 16 is a block diagram of a third example of the head drive control device to control driving of the liquid discharge head according to any embodiment of the present disclosure.

Next, with reference to FIG. 16, a description is given of a third example of the head drive control device to control driving of the liquid discharge head according to any of the above-described embodiments. FIG. 16 is a block diagram of the third example of the head drive control device 700.

In the present embodiment, the drive waveform PV for discharging liquid generated at the driving waveform generator 701 is also used as the channel control waveform applied to the piezoelectric element 12B to deform the channel portion 41*a* of the liquid delivery channel 41.

Similarly with the above-described second example, in the present third example, the analog switch AS of the analog switch array 715B is turned on and off according to results of decoding applied to the piezoelectric element 12A to pressurize the individual liquid chamber 6 communicated with the liquid delivery channel 41 to be deformed with the piezoelectric element 12B.

Accordingly, when the drive waveform can also be used as the flow-amount control waveform, such a configuration can obviate generation of another flow-amount control waveform to drive the piezoelectric element 12B, thus allowing a simple configuration.

Figure 17:
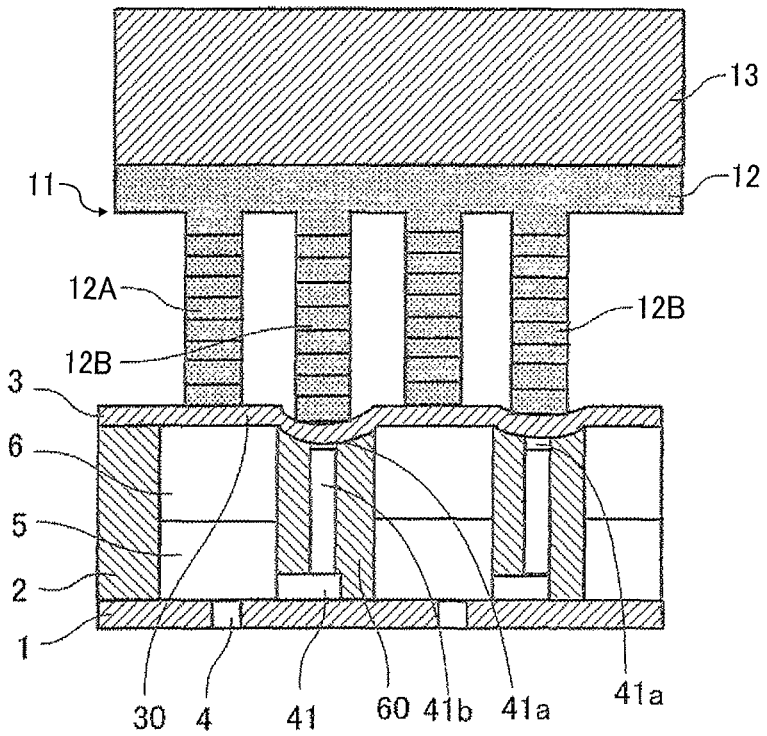
FIG. 17 is a cross-sectional view of the liquid discharge head according to a fourth embodiment of the present disclosure, cut in the nozzle array direction (the transverse direction of individual liquid chamber)

Next, a fourth embodiment of the present disclosure is described with reference to FIG. 17. FIG. 17 is a cross-sectional view of the liquid discharge head according to the fourth embodiment, cut in the nozzle array direction (the transverse direction of individual liquid chamber).

In the present embodiment, the amount of deformation of the piezoelectric element 12B is changed for each nozzle 4 corresponding to the liquid delivery channel 41, to level the discharge properties of the nozzles 4.

Figure 18A:
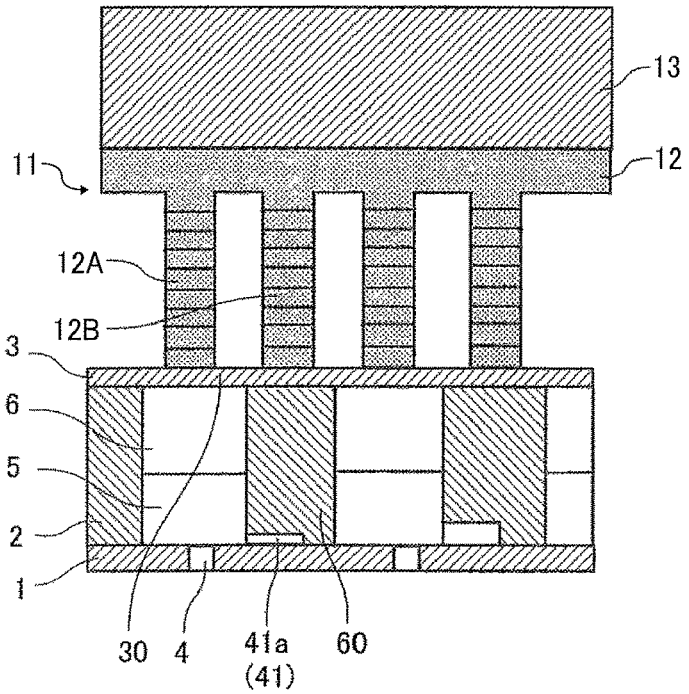
FIGS. 18A and 18B are cross-sectional views of the liquid discharge head according to a fifth embodiment of the present disclosure, cut in the nozzle array direction.
Figure 18B:
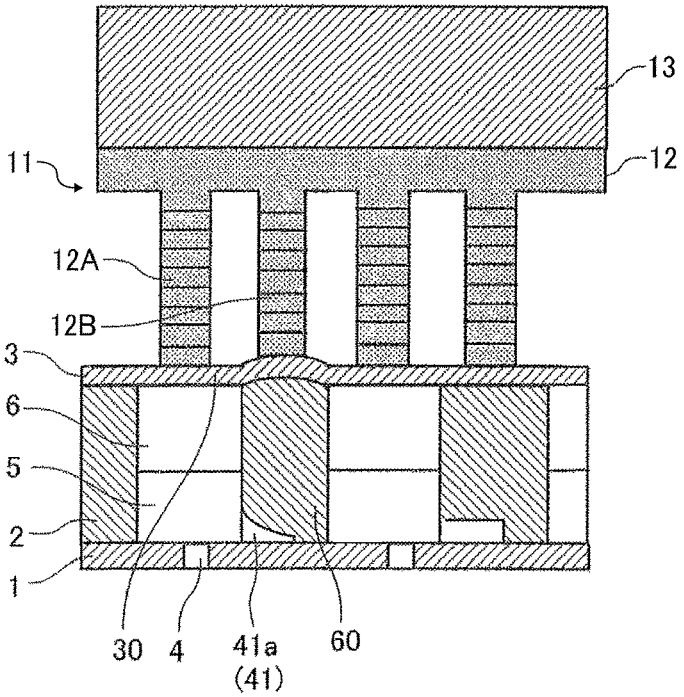

Next, a fifth embodiment of the present disclosure is described with reference to FIGS. 18A and 18B. FIGS. 18A and 18B are cross-sectional views of the liquid discharge head according to the fifth embodiment, cut in the nozzle array direction.

In the present embodiment, unlike the above-described embodiments, when the piezoelectric element 12B is not driven, as illustrated in FIG. 18A, the channel portion 41*a* of the liquid delivery channel 41 acts as a fluid restrictor having a fluid resistance value.

By driving the piezoelectric element 12B, as illustrated in FIG. 18B, the piezoelectric element 12B is contracted to increase the cross-sectional open area of the channel portion 41*a* and reduce the fluid resistance of the channel portion 41*a* acting as the fluid restrictor.

Hence, in the present embodiment, when liquid discharge from the nozzle 4 is not performed, the piezoelectric element 12B is driven to reduce the fluid resistance of the channel portion 41*a* being the fluid restrictor of the liquid delivery channel 41.

In other words, for the liquid discharge apparatus in which liquid is constantly discharged and maintenance is infrequently performed, the occasion of reducing the fluid resistance of the channel portion 41*a* is relatively few. Therefore, the time in which the piezoelectric element 12B is not driven can be relatively long, thus facilitating drive control.

By contrast, in the case in which the time of liquid discharge is short, the drive control is facilitated with the configuration in which the fluid resistance of the channel portion 41*a* is reduced in a non-driving state of the piezoelectric element 12B.

Figure 19:
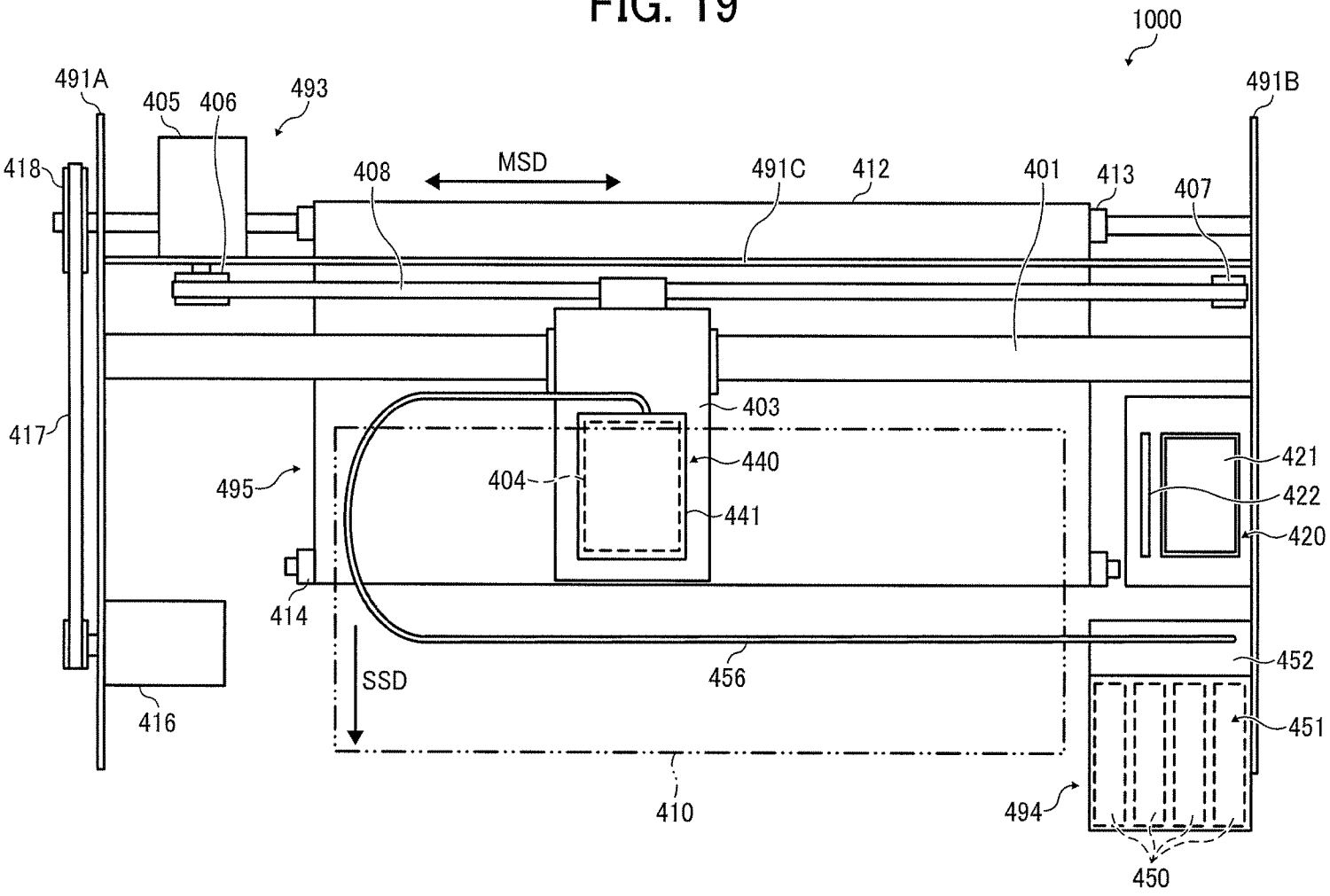
FIG. 19 is a plan view of a portion of a liquid discharge apparatus according to an embodiment of the present disclosure.
Figure 20:
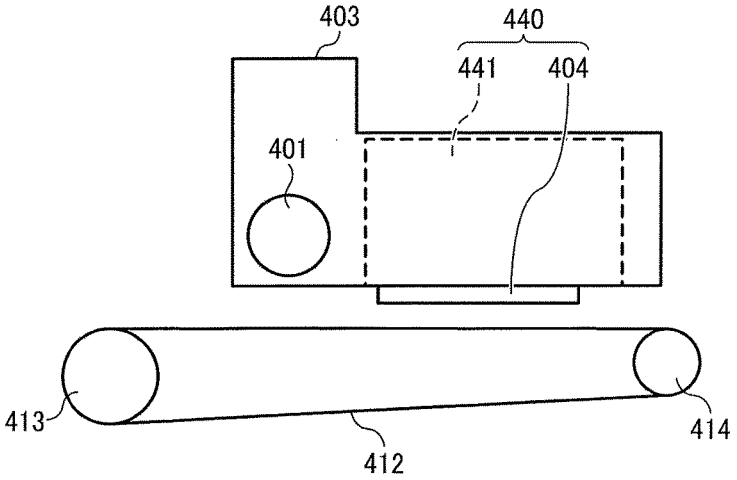
FIG. 20 is a side view of a portion of the liquid discharge apparatus of FIG. 19 including a liquid discharge device.

Next, a liquid discharge apparatus according to an embodiment of the present disclosure is described with reference to FIGS. 19 and 20. FIG. 19 is a plan view of a portion of the liquid discharge apparatus according to an embodiment of the present disclosure. FIG. 20 is a side view of a portion of the liquid discharge apparatus of FIG. 19.

A liquid discharge apparatus 1000 according to the present embodiment is a serial-type apparatus in which a main scan moving unit 493 reciprocally moves a carriage 403 in a main scanning direction indicated by arrow MSD in FIG. 19. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 19, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount liquid cartridges 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridges 450.

The liquid discharge apparatus 1000 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, the sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 1000 includes the liquid discharge head 404 according to an embodiment of the present disclosure, thus allowing stable formation of high quality images.

Figure 21:
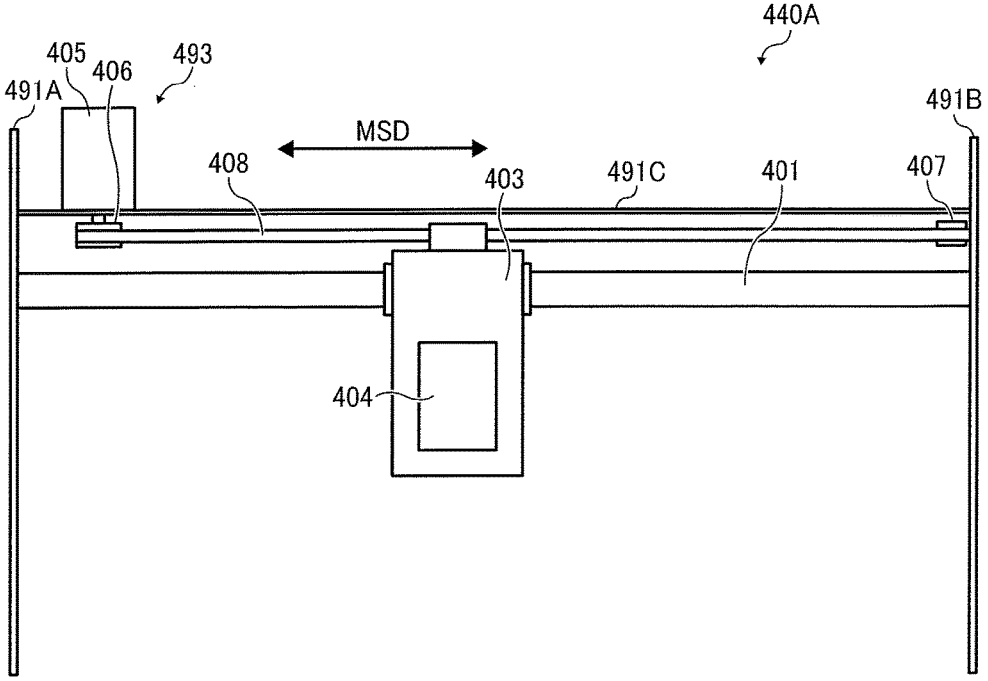
FIG. 21 is a plan view of a portion of another example of the liquid discharge device.

Next, another example of the liquid discharge device according to an embodiment of the present disclosure is described with reference to FIG. 21. FIG. 21 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 1000. The left side plate 491A, the right side plate 491B, and the rear side plate 491C constitute the housing.

Note that, in the liquid discharge device 440A, at least one of the maintenance unit 420 and the supply unit 494 may be mounted on, for example, the right side plate 491B.

Figure 22:
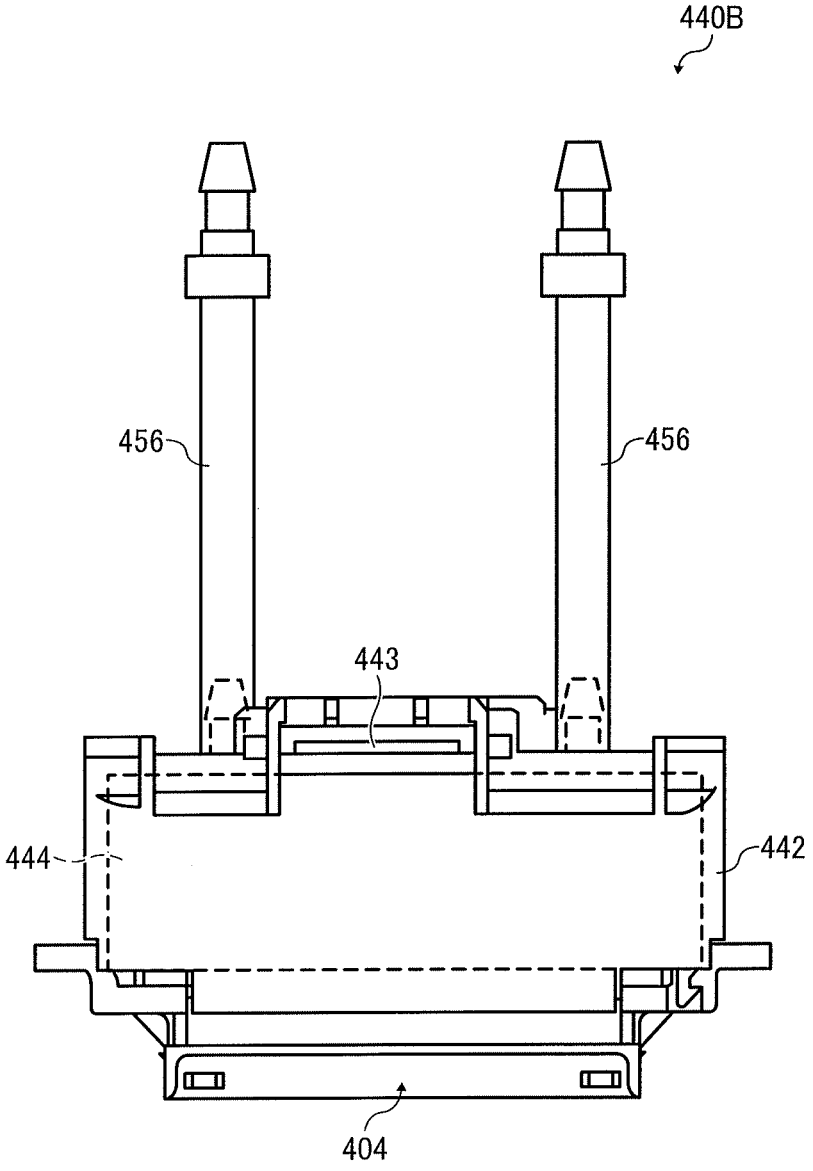
FIG. 22 is a front view of still another example of the liquid discharge device.

Next, still another example of the liquid discharge device according to an embodiment of the present disclosure is described with reference to FIG. 22. FIG. 22 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

Figure 23:
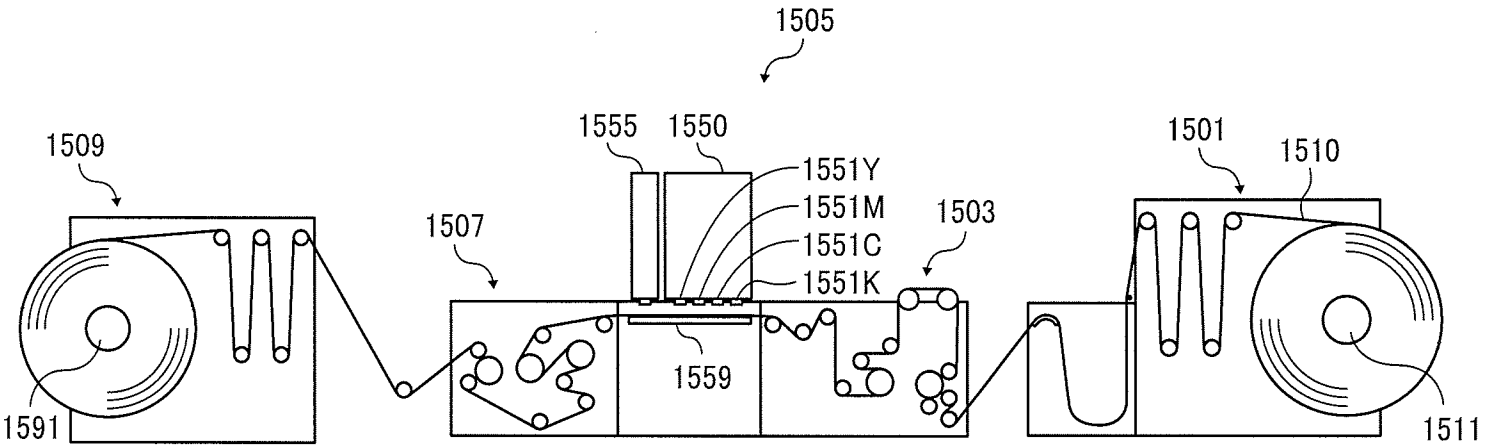
FIG. 23 is an illustration of the liquid discharge apparatus according to an embodiment of the present disclosure.
Figure 24:
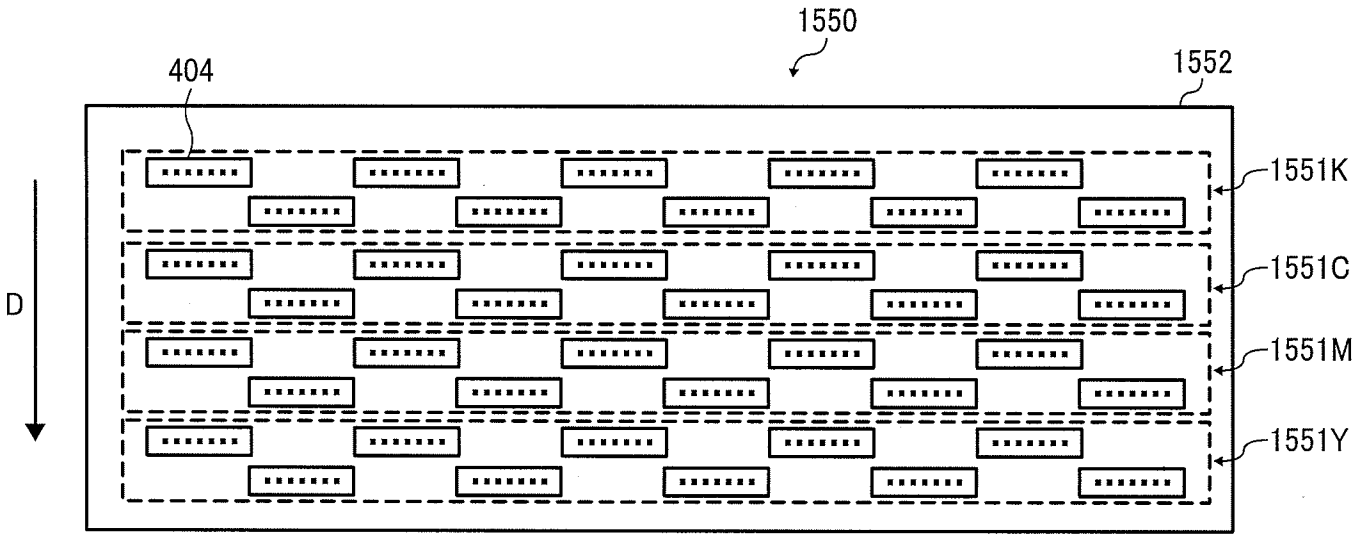
FIG. 24 is a plan view of a head unit of the liquid discharge apparatus of FIG. 23 according to an embodiment of the present disclosure.

Next, another example of the liquid discharge apparatus according to an embodiment of the present disclosure is described with reference to FIGS. 23 and 24. FIG. 23 is an illustration of the liquid discharge apparatus according to an embodiment of the present disclosure. FIG. 24 is a plan view of a head unit of the liquid discharge apparatus of FIG. 23.

The liquid discharge apparatus 1000 includes a feeder 1501 to feed a continuous medium 1510, such as a rolled sheet, a guide conveyor 1503 to guide and convey the continuous medium 1510, fed from the feeder 1501, to a printing unit 1505, the printing unit 1505 to discharge liquid onto the continuous medium 1510 to form an image on the continuous medium 1510, a drier unit 1507 to dry the continuous medium 1510, and an ejector 1509 to eject the continuous medium 1510.

The continuous medium 1510 is fed from a root winding roller 1511 of the feeder 1501, guided and conveyed with rollers of the feeder 1501, the guide conveyor 1503, the drier unit 1507, and the ejector 1509, and wound around a winding roller 1591 of the ejector 1509.

In the printing unit 1505, the continuous medium 1510 is conveyed opposite a first head unit 1550 and a second head unit 1555 on a conveyance guide 1559. The first head unit 1550 discharges liquid to form an image on the continuous medium 1510. Post-treatment is performed on the continuous medium 1510 with treatment liquid discharged from the second head unit 1555.

Here, the first head unit 1550 includes, for example, four-color full-line head arrays 1551K, 1551C, 1551M, and 1551Y (hereinafter, collectively referred to as "head arrays 1551" unless colors are distinguished) from an upstream side in a feed direction of the continuous medium 1510 (hereinafter, "medium feed direction") indicated by arrow D in FIG. 24.

The head arrays 1551K, 1551C, 1551M, and 1551Y are liquid dischargers to discharge liquid of black (K), cyan (C), magenta (M), and yellow (Y) onto the continuous medium 1510. Note that the number and types of color are not limited to the above-described four colors of K, C, M, and Y and may be any other suitable number and types.

In each head array 1551, for example, as illustrated in FIG. 24, a plurality of liquid discharge heads 404 are arranged in a staggered manner on a base 1552 to form the head array. Noted that the configuration of the head array 1551 is not limited to such a configuration. Note that, in FIG. 24, the first head unit 1550 is illustrated in a simplified manner.

Figure 25:
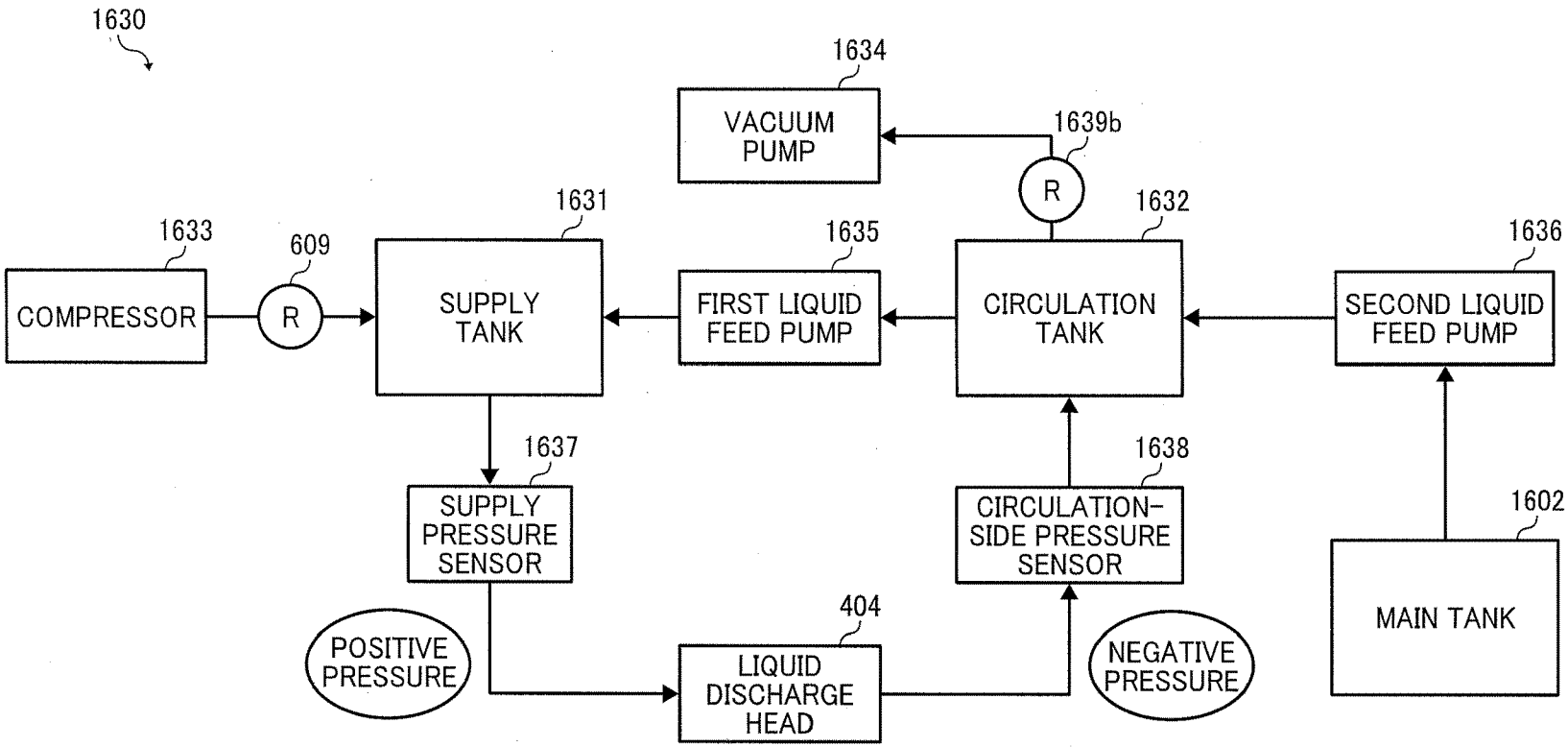
FIG. 25 is a block diagram of a liquid circulation system of the liquid discharge apparatus of FIG. 23 according to an embodiment of the present disclosure.

Next, an example of a liquid circulation system according to an embodiment of the present disclosure is described with reference to FIG. 25. FIG. 25 is a block diagram of the liquid circulation system according to an embodiment of the present disclosure.

A liquid circulation system 1630 illustrated in FIG. 25 includes, e.g., a main tank 1602, the liquid discharge head 404, a supply tank 1631, a circulation tank 1632, a compressor 1633, a vacuum pump 1634, a first liquid feed pump 1635, a second liquid feed pump 1636, a supply pressure sensor 1637, a circulation pressure sensor 1638, a regulator (R) 1639*a*, and a regulator (R) 1639*b*.

The supply pressure sensor 1637 is disposed between the supply tank 1631 and the liquid discharge head 1404 and connected to a supply channel side connected to the supply ports communicated with the common liquid chamber 10 of the liquid discharge head 404. The circulation pressure sensor 1638 is disposed between the liquid discharge head 404 and the circulation tank 1632 and connected to a delivery channel side connected to the delivery port communicated with the common liquid chamber 45 of the liquid discharge head 404.

One end of the circulation tank 1632 is connected to the supply tank 1631 via the first liquid feed pump 1635 and the other end of the circulation tank 1632 is connected to the main tank 1602 via the second liquid feed pump 1636.

Thus, liquid is flown from the supply tank 1631 into the liquid discharge head 404 through the supply ports and output from the circulation ports to the circulation tank 1632. Further, the first liquid feed pump 1635 feeds liquid from the circulation tank 1632 to the supply tank 1631, thus circulating liquid.

The supply tank 1631 is connected to the compressor 1633 and controlled so that a predetermined positive pressure is detected with the supply pressure sensor 1637. The circulation tank 1632 is connected to the vacuum pump 1634 and controlled so that a predetermined negative pressure is detected with the circulation pressure sensor 1638.

Such a configuration can maintain the negative pressure of meniscus constant while constantly circulating liquid from the common liquid chambers, via the individual liquid chambers and the liquid delivery channels, to the circulation common liquid chambers.

When droplets are discharged from the nozzles 4 of the liquid discharge head 404, the amount of liquid in each of the supply tank 1631 and the circulation tank 1632 decreases. Hence, the second liquid feed pump 1636 replenishes liquid from the main tank 1602 to the circulation tank 1632. The replenishment of liquid from the main tank 1602 to the circulation tank 1632 is controlled in accordance with a result of detection with, e.g., a liquid level sensor in the circulation tank 1632, for example, in a manner in which liquid is replenished when the liquid level of liquid in the circulation tank 1632 is lower than a predetermined height.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, examples of the integrated unit include a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) s each other.

For example, the liquid discharge head and a head tank are integrated as the liquid discharge device. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. The liquid discharge device may include the liquid discharge head, the carriage, and the main scan moving unit that are integrated as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Further, in another example, the liquid discharge device includes tubes connected to the head tank or the channel member mounted on the liquid discharge head so that the liquid discharge head and the supply assembly are integrated as a single unit. Liquid is supplied from a liquid reservoir source to the liquid discharge head.

The main-scan moving unit may be a guide only. The supply unit may be a tube(s) only or a loading unit only.

The term "liquid discharge apparatus" used herein also represents an apparatus including the liquid discharge head or the liquid discharge device to discharge liquid by driving the liquid discharge head. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head, comprising:

a plurality of nozzles, formed by a nozzle forming member, to discharge liquid;

a plurality of individual liquid chambers communicated with the plurality of nozzles;

a partition wall disposed between adjacent individual liquid chambers amongst the plurality of individual liquid chambers;

a plurality of liquid delivery channels communicated with the plurality of individual liquid chambers, wherein a liquid delivery channel amongst the plurality of liquid delivery channels includes a channel portion disposed adjacent to the nozzle forming member and adjacent to the partition wall; and a deformation unit to deform, via the partition wall, at least a portion of the channel portion that is disposed adjacent to the nozzle forming member and adjacent to the partition wall, the liquid delivery channel being a cavity bounded by (i) the partition wall between said adjacent individual liquid chambers and (ii) the nozzle forming member.

2. The liquid discharge head according to claim 1, further comprising a plurality of nozzle communication channels communicating the plurality of nozzles with the plurality of individual liquid chambers, wherein the plurality of liquid delivery channels is communicated with the plurality of individual liquid chambers via the plurality of nozzle communication channels.

3. The liquid discharge head according to claim 1, wherein the deformation unit is an electromechanical transducer element linked to the partition wall.

4. The liquid discharge head according to claim 1, wherein the channel portion has a deformable wall surface, and wherein the deformation unit is an electromechanical transducer element linked to the wall surface.

5. The liquid discharge head according to claim 4, further comprising another electromechanical transducer element to pressurize the plurality of individual liquid chambers, wherein the electromechanical transducer element linked to the wall surface is disposed adjacent to said another electromechanical transducer element.

6. A liquid discharge device, comprising the liquid discharge head according to claim 1, to discharge the liquid.

7. The liquid discharge device according to claim 6, wherein the liquid discharge head is integrated as a single unit with at least one of:

a head tank to store the liquid to be supplied to the liquid discharge head;

a carriage mounting the liquid discharge head;

a supply unit to supply the liquid to the liquid discharge head;

a maintenance unit to maintain and recover the liquid discharge head; and a main scan moving unit to move the liquid discharge head in a main scanning direction.

8. A liquid discharge apparatus comprising the liquid discharge device according to claim 6, to discharge the liquid.

9. The liquid discharge apparatus according to claim 8, further comprising a drive controller to control driving of the deformation unit, wherein the drive controller is configured to, on discharging liquid from the plurality of nozzles, deform the channel portion with the deformation unit to increase fluid resistance to the liquid at the channel portion.

10. The liquid discharge apparatus according to claim 9, wherein the drive controller is configured to, on discharging liquid from the plurality of nozzles, deform the channel portion once or more with the deformation unit and generate a pressure wave toward an entry side of the liquid delivery channel.

11. The liquid discharge apparatus according to claim 9, wherein the drive controller is configured to separately drive the deformation unit and another deformation unit.

12. The liquid discharge apparatus according to claim 8, wherein the plurality of liquid delivery channels constitutes a circulation channel to constantly flow the liquid regardless of whether an operation of discharging liquid from the plurality of nozzles is performed.

13. A liquid discharge apparatus comprising the liquid discharge head according to claim 1, to discharge the liquid.

* * * * *